United States Patent [19]

Murakami et al.

[11] Patent Number: 4,941,762

[45] Date of Patent: Jul. 17, 1990

[54] SWITCHING MECHANISM FOR A PAPER HOLDING ROLLER OF A PRINTER

[75] Inventors: Kenjiro Murakami; Yukihiro Uchiyama, both of Nagano, Japan

[73] Assignee: Seiko Epson Corporation, Tokyo, Japan

[21] Appl. No.: 302,653

[22] Filed: Jan. 27, 1989

[30] Foreign Application Priority Data

Jan. 28, 1988 [JP] Japan ..... 63-18116
Jan. 28, 1988 [JP] Japan ..... 63-18117

[51] Int. Cl.[5] ..... B41J 13/02
[52] U.S. Cl. ..... 400/636.1; 400/639.1
[58] Field of Search ..... 400/636, 636.1, 636.2, 400/637.1, 639, 639.1, 639.2, 185, 187, 219, 219.1, 212.2

[56] References Cited

U.S. PATENT DOCUMENTS

| | | | |
|---|---|---|---|
| 2,210,168 | 8/1940 | Hart | 400/639.2 |
| 3,923,267 | 12/1975 | Eckerd | 400/219.1 |
| 4,031,995 | 6/1977 | Blum et al. | 400/636.1 |
| 4,338,035 | 7/1982 | Kondo et al. | 400/187 |
| 4,498,795 | 2/1985 | Tatara | 400/637.1 |
| 4,581,618 | 4/1986 | Watanabe et al. | 400/636.1 |
| 4,630,814 | 12/1986 | Kawakubo et al. | 400/639.1 |
| 4,722,624 | 2/1988 | Musso | 400/636.1 |

FOREIGN PATENT DOCUMENTS

| | | | |
|---|---|---|---|
| 216394 | 4/1987 | European Pat. Off. | 400/636.1 |
| 86277 | 5/1986 | Japan | 400/187 |

OTHER PUBLICATIONS

"Automatic Paper Bail Closing Device", IBM Technical Disclosure Bulletin, vol. 28, No. 1, pp. 250–251, 6–85.

*Primary Examiner*—Eugene H. Eickholt
*Attorney, Agent, or Firm*—Blum Kaplan

[57] ABSTRACT

A mechanism for switching a paper holding roller of an automatically feeding printer between a contact position for holding a paper against the platen and a separation position away from the platen utilizing the platen power source. A transmission mechanism includes a trigger which is moved selectively by an electro-magnetic member to engage a gear between the platen power source and a roller lever on which the paper holding roller is mounted to move the paper holding roller between the contact/separation positions. In one embodiment, two partial gears engage a gear portion of the lever to move the lever in both directions. In another embodiment, an epicyclic lever is selectively rotated in one of two directions to engage one of two oppositely rotating epicyclic gears to move the paper holding roller.

19 Claims, 5 Drawing Sheets

SWITCHING MECHANISM FOR A PAPER HOLDING ROLLER OF A PRINTER

BACKGROUND OF THE INVENTION

The invention relates generally to the paper handling features of a printer and more particularly to a switching mechanism for engaging and disengaging a paper holding roller for holding paper against the platen.

Printers are commonly used in connection with personal computers and word processors. Typically, the paper feeding mechanism of the printer includes a lever and bar for contacting paper holding rollers to recording paper to secure the paper to a platen during printing and releasing the rollers so that paper can be fed into the printer. As shown in FIG. 10, common paper holder switching mechanisms include a spring 205 to exert a large force on a bar 206 that supports a plurality of rollers 204 to hold the rollers firmly against a platen 203. Conventional printers commonly utilize the attractive force of a large solenoid 202 to rotate bar 206 to release rollers 204 from platen 203. When solenoid 202 pulls a bottom portion of bar 206 in the direction of arrow A, against the force of spring 205, paper holding rollers 204 separate from platen 203 in the direction of arrow S. When solenoid 202 is released, spring 205 holds paper holding rollers 204 against platen 203. Solenoid 202 must be powerful enough to overcome the substantial force of spring 205 which must exert sufficient force to properly secure paper to platen 203.

This conventional paper handling feature has shortcomings. If the printer is a manually operated printer, the paper rollers must be manually released from the platen each time paper is inserted or released. If the printer feeds paper automatically, a large solenoid is used to overcome the strong force of the spring that holds the rollers against the platen. Printers that utilize large solenoids to overcome the force of paper holding springs have durability and reliability problems and can be expensive.

Accordingly, it is desirable to provide an improved paper holder switching mechanism that does not require the a large solenoid and overcomes the shortcomings of the prior art.

SUMMARY OF THE INVENTION

Generally speaking, in accordance with the invention, a switching mechanism for the paper holding roller of an automatically feeding printer is provided for engaging and disengaging the paper holding rollers of a printer from a platen. The switching mechanism utilizes the power of a drive motor that also rotates the platen, rather than a solenoid, to secure and release the paper holding rollers to the platen. The mechanism includes a small solenoid to engage and disengage the drive motor from a mechanism for securing and releasing the rollers and the platen.

Accordingly, it is an object of the invention to provide an improved switching mechanism for securing and releasing a paper holding roller and a platen of a printer which is less costly than conventional switching mechanisms.

Another object of the invention is to provide an improved switching mechanism for securing and releasing a paper holding roller and a platen of a printer that is more durable and reliable then prior art switching mechanisms.

A further object of the invention is provide an improved switching mechanism for securing and releasing a paper holding roller and a platen of a printer which does not require the inclusion of large, powerful solenoids.

Still other objects and advantages of the invention will in part be obvious and will in part be apparent from the specifications and drawings.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
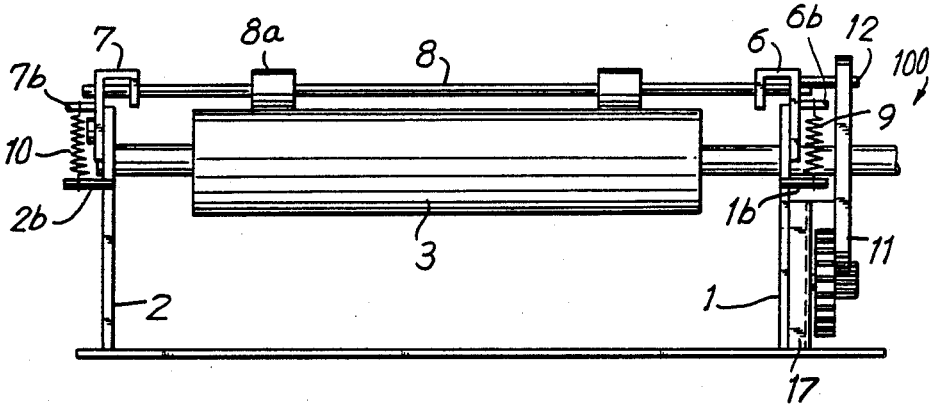
FIG. 1 is a partial plan view of a printer including a switching mechanism for a print paper roller constructed in accordance with a first embodiment of the invention.

Referring generally to FIG. 1, a switching mechanism 100 for a paper holding roller constructed in accordance with a first embodiment of the invention is illustrated in partial plan view. The printer includes a platen 3 mounted between opposed frame side walls 1 and 2 and paper holding rollers 8*a* rotatably mounted on a paper holder rod 8 for firmly holding paper against platen 3. Paper holding roller switching mechanism 100 is used to selectively displace paper holding rollers 8*a* between contacting platen 3 and an open position in which they are displaced away from contact with platen 3.

Paper holder rod 8 is supported at its ends by a pair of paper rod levers 6 and 7 which are pivotally mounted to frame side walls 1 and 2, respectively by a pair of shafts 4 and 5, respectively. A pair of paper rod lever springs 9 and 10 are secured between paper rod levers 6 and 7 at projection 6*b* and 7*b* and frame side wall 1 and 2 at projections 1*b* and 2*b*, respectively. Springs 9 and 10 hold paper rod levers 6 and 7 and paper holder rod 8 in a stable position whether engaged with platen 3 or displaced away therefrom.

A paper feeding motor (not shown) for supplying the power necessary for rotating a platen gear 3*a* fixed to platen 3 is provided and is used to move paper holder rod 8 between its open or disengaged position and its closed or contacting position. When paper holder rod 8 is in its closed or engaged position, paper holding rollers 8*a* hold a paper P against platen 3 and advance paper P as gear 3*a* is turned. Throughout the application, similar elements shown in the figures will be identically numbered.

Figure 2:
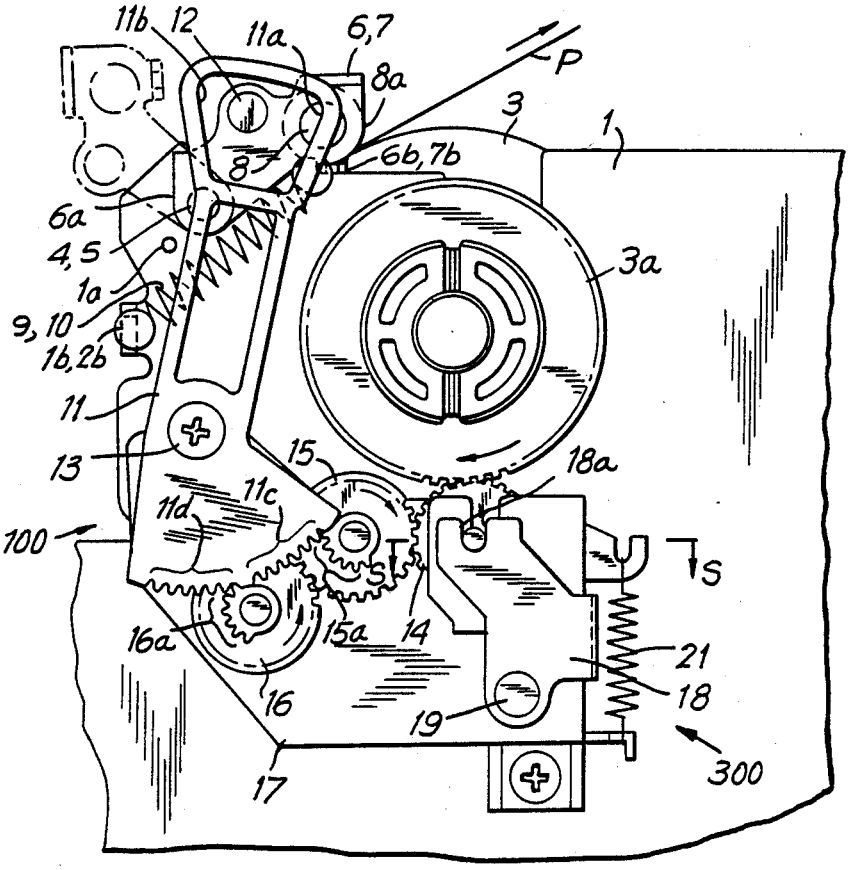
FIG. 2 is a sectional view of the switching mechanism of the printer of FIG. 1.
Figure 3:
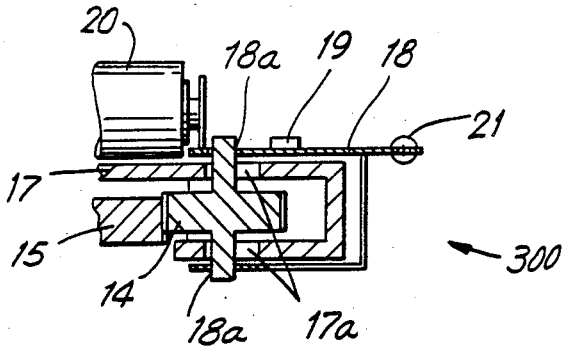
FIG. 3 is a sectional view taken along line S—S of FIG. 2.
Figure 4:
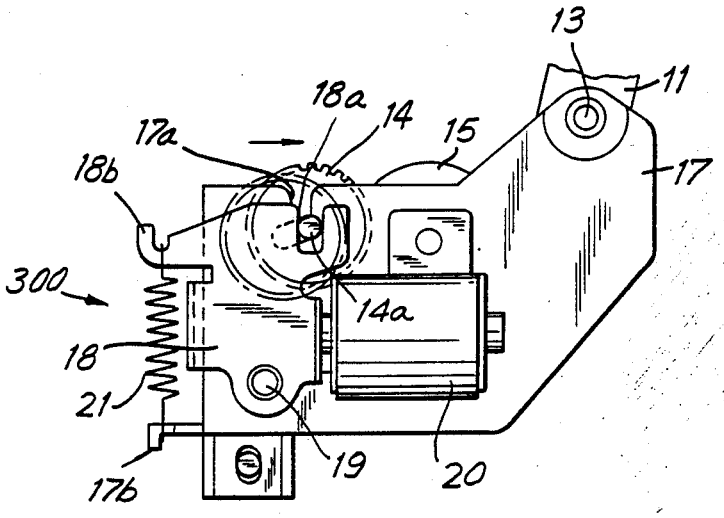
FIG. 4 is a side elevational view of the bigger lever portion of the switching mechanism of FIG. 2 and FIG. 3.

Paper holding rollers 8*a* are switched between the contact/separation position by a trigger mechanism 300 as shown in FIGS. 2, 3 and 4. FIG. 3 is a partial section view of trigger mechanism 300 taken along line S—S of FIG. 2. A pair of guide grooves 17*a* are formed in a trigger frame 17. A transmission gear 14 on a transmission gear shaft 14*a* is slidably positioned in grooves 17*a*. Trigger frame 17 also rotatably supports a pair of gears 15 and 16. Gears 15 and 16 are formed with supplemental partial gear portions 15*a* and 16*a*, respectively. A metal trigger plate 18 is rotatably supported on frame 17 by a shaft 19. Trigger plate 18 is formed with a pair of guide grooves 18*a* to slide shaft 14*a* of transmission gear 14 within groove 17*a* of trigger frame 17.

Trigger plate 18 is biased away from platen 3 by a trigger spring 21 mounted between a spring hook 17*b* on trigger frame 17 and a trigger plate hook 18*b* on trigger plate 18. Spring 21 exerts a light compressing force on hook 18*b* to exert a clockwise rotating force on trigger plate 18 as illustrated in FIG. 2. Spring 21 rotates trigger plate 18 and guide grooves 17*a* slidably position transmission gear 14 to a position where it does not engage platen gear 3*a*. In this position, rotation of platen gear 3*a* will not affect the operation of paper holder switching mechanism 100 and will not contact or separate paper holding rollers 8*a*.

A trigger solenoid 20 mounted on the rear side of trigger frame 17 is shown in FIG. 4. Trigger solenoid 20 is coupled to trigger plate 18 and when energized attracts trigger plate 18. When trigger plate 18 is attracted by solenoid 20, trigger plate guide grooves 18*a* slide gear shaft 14*a* in trigger frame guide grooves 17*a* and position transmission gear 14 into engagement with both platen gear 3*a* and gear 15. When gear 14 engages platen gear 3*a*, the force of paper feeding motor is transmitted from platen gear 3*a* into transmission gear 14 and gears 15 and 16.

A guide lever 11 is pivotally mounted to trigger frame 17 by a screw 13. The free upper arm of lever 11 defines a substantially trapezoidal inwardly facing surface including guide shaft surfaces 11*a* and 11*b* for guiding a shaft 12 mounted on paper rod lever 6 which protrudes through the region between guide surfaces 11*a* and 11*b*. The opposed lower arm for lever 11 includes a pair of gear portions 11*c* and 11*d* engaging supplemental partial gears 15*a* and 16*a*. The center of the pitch circle of gear portions 11*c* and 11*d* is screw 13.

Figure 5:
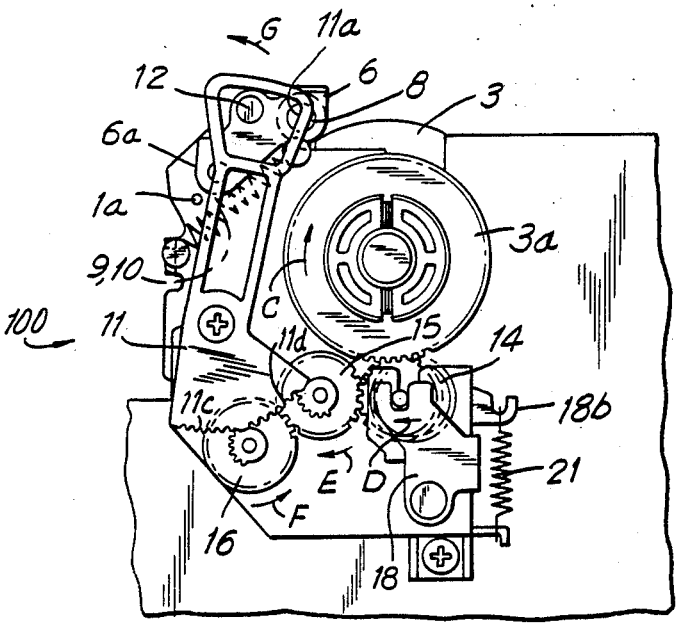
FIG. 5 is a side elevational view illustrating the operation of the portion of the switching mechanism shown in FIG. 2 with the paper holding roller engaging the platen.
Figure 6:
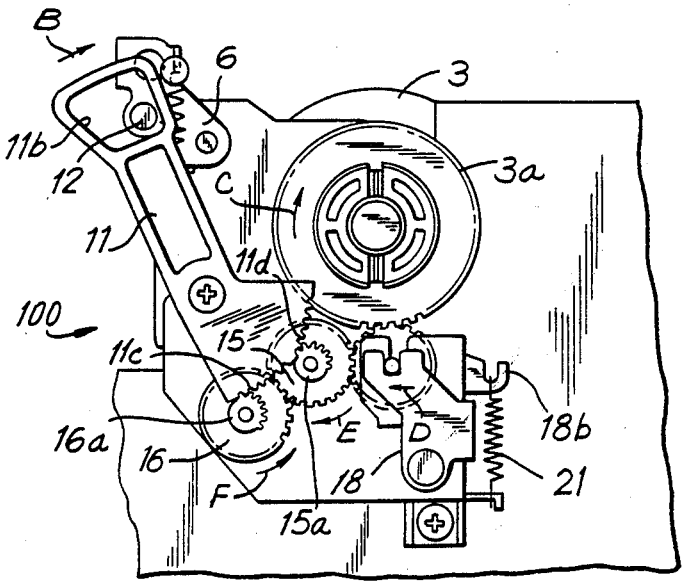
FIG. 6 is a side elevational view illustrating the operation of the portion of the switching mechanism shown in FIG. 2 with the paper holding roller disengaged from the platen.

Operation of switch mechanism 100 to displace paper holder rod 8 between the contact/separation positions will be described with reference to FIGS. 5 and 6. FIG. 5 illustrates the position of elements of mechanism 100 in which paper holder rod 8 is in the contact position prior to being displaced from platen 3 and FIG. 6 illustrates the operation as paper holder rod 8 is in the separation position about to be moved to the contact position towards platen 3.

Normally, paper holder rod 8 and paper holding rollers 8*a* are held in the contact position on platen 3 by the compression force of springs 9 and 10. Gear 14 is not engaged with gear 15 due to the bias of spring 21. While platen gear 3*a* is rotated, lever 11 does not operate.

When solenoid 20 is energized (FIG. 5), trigger plate 18 is attracted and overcomes the light compression force of trigger spring 21 and moves transmission gear 14 along guide groove 18*a* to the position where gear 14 can engage platen gear 3*a* and gear 15. In this position, the driving force of paper feeding motor is transmitted to gears 15 and 16. Gear 15 rotates in the direction of arrow E and gear 16 rotates in the direction of arrow F.

Since there are no gear teeth on supplemental gear portion 16*a* for engaging gear portion 11*c*, gear 166 and gear portion 11*c* rotate without any engagement. Supplemental partial gear 15*a* of gear 15 engages gear surface 11*d* to rotate lever 11 in a counterclockwise direction G about screw 13. As lever 11 is rotated in the direction of arrow G, front guide shaft surface 11*a* contacts lever guide shaft 12 and pivots paper rod lever 6 causing paper holder rod 8 to move in the direction of arrow G until a stop surface 6*a* of paper rod lever 6 contacts a protruding stop 1*a* of frame side 1. In this separation position, paper holder rod 8 is held in place by the biasing force of paper lever springs 9 and 10.

At this point, the teeth of supplemental partial gear 15*a* are out of engagement with gear portion 11*c*. Rotation of lever 11 stops and solenoid 20 is de energized. Paper holding rod 8 is supported stably by springs 9 and 10 and transmission gear 14 disengages from platen gear 3*a*.

FIG. 6 illustrates the operation of mechanism 100 as paper holder rod 8 is moved from the separation position to the contact position in the direction of arrow B. In this case, operation of gears 15 and 16 is reversed. Solenoid 20 is energized which attracts trigger plate 18 and causes transmission gear 14 to engage platen gear 3*a* and gear 15. As gear 15 rotates in the direction of arrow E, partial gear 15*a* does not engage gear surface 11*d*. Now, as gear 16 rotates in the direction of arrow F, the teeth of partial gear 16*a* engage gear surface 11*c* and cause lever 11 to pivot in the direction of arrow B. As the upper guide region of lever 11 pivots in the direction of arrow B, guide shaft 12 contact surface 11*b* contacts lever guide shaft 12 and pivots paper rod lever 6 in the direction of arrow B and paper holding rollers 8*a* contact platen 3. Paper holder rod 8 is held securely in this contact position by springs 9 and 10.

In the assembly constructed in this manner, trigger spring 21 need not be as powerful a spring as guide springs 9 and 10. Spring 21 need only exert a light force to keep transmission gear 14 out of engagement with platen gear 3*a* and gear 15. Consequently, solenoid 20 need not be a large, powerful solenoid because it only has to overcome the light force exerted by trigger spring 21.

Springs 9 and 10 which maintain paper holder rod 8 in either an open or closed condition must exert sufficient force to hold paper securely to platen 3. However, the force to overcome springs 9 and 10 and open and close paper holder rod 8 is exerted by the paper feeding motor through platen gear 3*a* and transmission gear 14, not by a solenoid.

Figure 7:
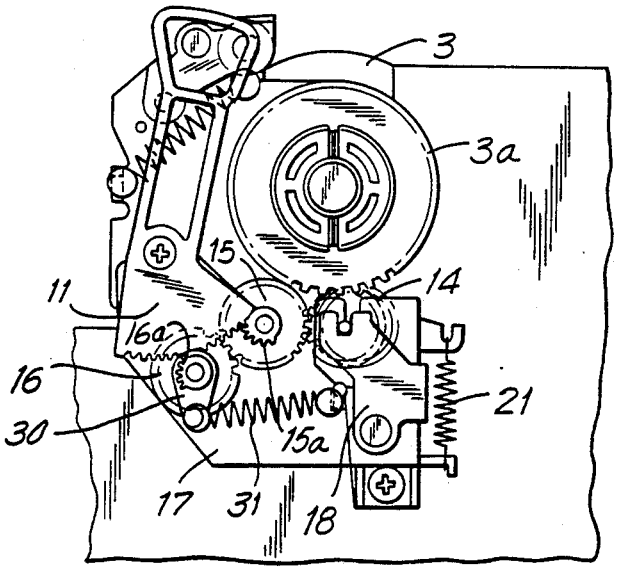
FIG. 7 is a side elevational view of a modified switching mechanism constructed in accordance with another embodiment of the invention.
Figure 10:
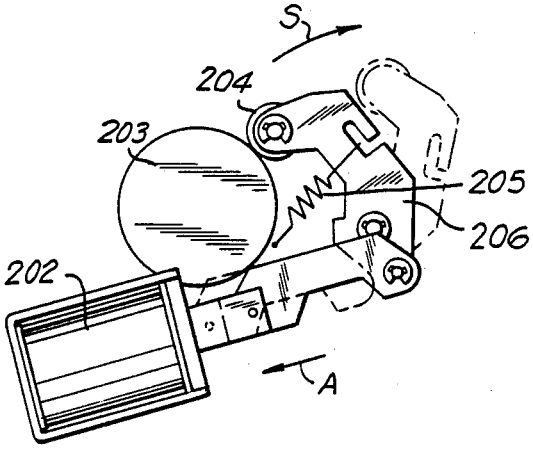
FIG. 10 PRIOR ART
FIG. 10 is a side elevational view illustrating the operation of a conventional switching mechanism for a paper holder.

A modification of paper holder switch mechanism 100 which ensures operation as described is shown in FIG. 7. A supplemental lever 30 is mounted on gear 16. A spring 31 having a small compression force is attached to lever 30 and trigger frame 17. Spring 31 exerts a weak biasing force to rotate gear 16 in a counterclockwise direction. When transmission gear 14 is disengaged from platen gear 3*a* and gear 15, supplemental partial gears 15*a* and 16*a* rotate and engage gear surface 11*c* or 11*d* by the weak force exerted by spring 31. This force is too weak to rotate partial gears 15*a* and 16*a* past the point of initial engagement so that lever 11 does not reposition paper holding rod 8. Accordingly, supplemental partial gears 15*a* or 16*a* will be maintained in a state of engagement with gear surfaces 11*c* and 11*d*. However, the force of spring 31 is weak so that it will not cause lever 11 to move. The advantage of this configuration is that because partial gears 15*a* or 16*a* are engaged with gear surfaces 11*c* or 11*d*, as soon as solenoid 20 is energized and gears 15 and 16 begin to move, either partial gear 15*a* or 16*a* will immediately cause lever 11 to pivot, without any back-lash.

Figure 8:
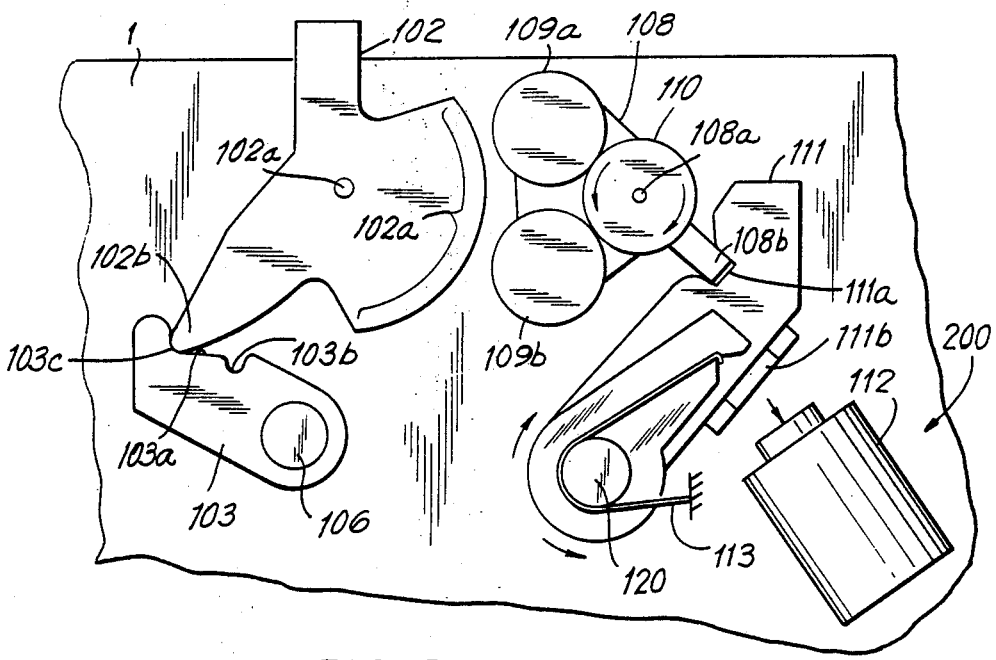
FIG. 8 is a side elevational view of a switching mechanism for a paper holding roller constructed in accordance with a further embodiment of the invention.
Figure 9:
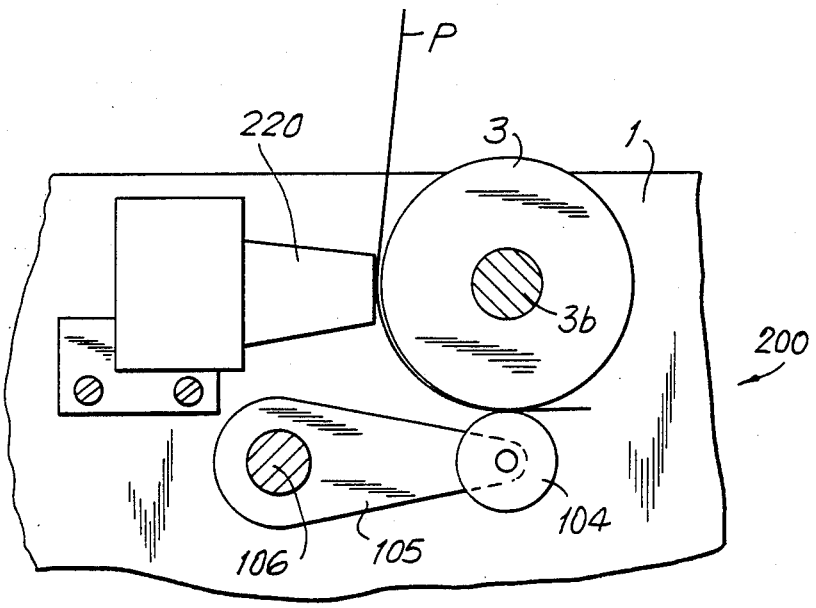
FIG. 9 is a side elevational view showing the paper holding roller engaged with the platen in the switching mechanism illustrated in FIG. 8.

A second embodiment of a paper holder switching mechanism constructed and arranged in accordance with the invention is shown generally as 200 in FIG. 8 and FIG. 9. FIG. 8 is a showing on the inside of frame side wall 2. FIG. 9 is a view of the outer side of frame side wall 1. Force of paper feeding motor which rotates platen 3 is used to displace a paper holding roller 104 between an open and closed condition. In this embodiment roller 104 is located upstream from print head 220 under platen 3 to advance paper P.

Paper holding roller 104 is rotatably mounted on a roller holder 105 which is fixed to a roller holder shaft 106 mounted on frame 1. A release lever 102 formed with a projecting arm 102*b* having a camming surface is rotatably mounted to frame 1 by a shaft 102*a*. Release lever projecting arm 102*b* is positioned to engage a camming wall 103*a* of a supplemental release lever 103 fixed to roller holder shaft 106. As release lever projecting arm 102*b* is moved from a cam groove 103*b* to a cam groove 103*c* formed in camming wall 103*a*, supplemental release lever 103 is pivoted about roller holder shaft 106. This pivots roller holder 105 to displace paper holding roller 104 between the open and closed positions.

Release lever 102 includes a release lever gear surface 102*a* facing a pair of epicyclic gears 109*a* and 109*b*, rotatably mounted to an epicyclic lever 108 that is pivotally mounted on frame side 1 by an epicyclic shaft 108*a*. Release lever gear surface 102*a* is formed to assume one of three positions. It can engage neither epicyclic gear 109*a* and 109*b* or either one of gears 109*a* and 109*b* which are engaged with a transmission gear 110. Transmission gear 110 is rotatably mounted on epicyclic shaft 108*a* and is fixed to a longitudinal axis of a platen shaft 3*b* of platen 3. Accordingly, when platen 3 is rotated by the paper feeding motor, transmission gear 110 also rotates and urges epicyclic lever 108 to pivot in the same direction as it is rotated.

A trigger plate 111 formed with a camming wall trigger groove surface 111*a* is pivotally mounted to frame side 1 by a trigger shaft 120. Trigger groove surface 111*a* is positioned to be in slidable contact with an epicyclic lever projection finger 108*b* protruding from epicyclic lever 108. When trigger plate 111 is biased in the counterclockwise direction about trigger shaft 120, trigger groove surface 111*a* exerts force on finger 108*b* to pivot epicyclic lever 108. A solenoid 112 is mounted on frame side wall 1 to attract a solenoid attractor portion 111*b* of trigger plate 111 when solenoid 112 is energized.

When solenoid 112 is activated, trigger plate is attracted and pivots in a clockwise direction overcoming the small force exerted by a trigger return spring 113 wrapped around trigger plate 111. At this time, epicyclic lever projection 108*b* disengages from trigger groove surface 111*a* and epicyclic lever 108 pivots in the same direction as the rotation of transmission gear 110 and either of epicyclic gears 109*a* or 109*b* engage release lever gear surface 102*a*. If shaft 108*a* rotates clockwise, gear 109*b* will engage release lever gear surface 102*a*. If shaft 108*a* rotates counterclockwise, gear 109*a* will engage gear surface 102*a*.

When solenoid 112 is de-energized, trigger return spring 113 urges trigger plate 111 to its original position towards epicyclic lever 108 and epicyclic lever finger 108*b* is re-engaged within trigger groove surface 111*a*. This pivots epicyclic lever 108*a* to disengage either of the engaged epicyclic gears 109*a* or 109*b* and transmission gear 110 rotates freely without affecting the condition of release lever 102.

Paper feeding roller 104 is moved from the contact position shown in FIG. 9 to a separation position as follows. Solenoid 112 is energized to attract trigger plate 111. When trigger plate 111 moves towards solenoid 112, finger 108*b* disengages from trigger groove surface 111*a*. Transmission gear 110 is rotated in the counterclockwise direction to engage clockwise rotating epicyclic gear 109*a* with release lever gear surface 102*a*. Release lever 102 rotates counterclockwise which causes release lever projection 102*b* to slide on camming wall 103*a* towards page holding roller holder shaft 106 to rest in cam groove 103*b*. Cam groove 103*b* holds release lever 102 fixed in place until it is forced back towards cam groove 103*c*. Solenoid 112 is then de-energized and trigger plate 111 is forced by trigger return spring 113 towards epicyclic lever 108 and finger 108*b* of epicyclic lever 108 engages trigger groove surface 111*a*. Epicyclic lever 108 pivots clockwise and epicyclic gear 109*b* is disengaged from release lever gear surface 102.

Paper holding roller 104 is placed in a closed contact position in contact with platen 3 by energizing solenoid 112 to disengage epicyclic lever 108 from trigger plate 111. The paper feeding motor is rotated in a reverse direction relative to the above description to cause transmission gear 110 to rotate in a clockwise direction as shown in FIG. 8. Epicyclic lever 108 then pivots in a clockwise direction and epicyclic gear 109*b* is rotated in a counterclockwise direction to engage release lever gearing surface 102*a*. Release lever 102 is then pivoted clockwise and release lever projection 102*b* slides up camming wall 103*a* into cam groove 103*c*. This rotates paper roller holder shaft 106 in a direction to pivot roller holder 105 and counterclockwise paper holding rollers 104 towards platen 3.

When solenoid 112 is not energized, epicyclic gears 109*a* and 109*b* are not in contact with release lever 102. Accordingly, roller holder 105 can be operated manually. When release lever projection 102*b* nests in cam grooves 103*c* or 103*b*, roller holder 105 will be stably maintained in either the open or closed position without the application of any external stabilizing force.

Printers that include roller holder switching mechanisms constructed in accordance with the invention have advantages over various mechanisms utilized in conventional printers. The power source that feeds paper through the printer is also used to displace paper roller holder 1 in the contact or separation positions. Consequently, a separate power source for releasing the rollers is not required. Only a small, low power solenoid is needed to engage or disengage the paper holder from the paper feeding drive mechanism. Because only small, low power solenoids are required, the reliability of such printers can be improved and the cost of such printers can be lowered.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed:

1. In a printer including a frame, a platen rotatably mounted on the frame, a platen power source coupled to the platen for rotating the platen, and an apparatus for selectively moving a print paper holding member between a contact position holding a print paper against the platen and a separation position away from the platen, the improvement which comprises:

paper holding means including the paper holding member and power transmission means for selectively transmitting power from the platen power source to the paper holding means to move the paper holding member between the contact and separation positions, the power transmission means including trigger means selectively displaceable between a first disengaged position in which the platen power source is not engaged with the paper holding means and a second engaged position in which the platen power source is operatively engaged with the paper holding means for selectively displacing the paper holding means and paper holding member from the separation position to the contact position or from the contact position to the separation position.

2. The printer of claim 1, wherein the trigger means includes a trigger gear operatively engageable with the platen power source and the paper holding means, the paper holding means including a position lever having a free end and a gear end operatively coupled to the paper holding member, the position lever pivotally mounted on the printer, the position lever pivoting between a contact position in which the free end of the position lever disposes the paper holding member in contact with the platen and a separation position in which the free end of the position lever disposes the paper holding member away from the contacting position and when the position lever is in the contact position and the trigger means is displaced to the engaged position the trigger gear will engage the gear means of the position lever and displace the position lever to the separation position and when the position lever is in the separation position and the trigger means is displaced to the engaged position, the trigger gear will engage the gear means of the position lever to pivot the position lever to the contact position.

3. The printer of claim 2, wherein the trigger means includes a gear frame with first and second partial gears mounted on the gear frame for operative engagement with the gear means on the position lever and operatively engaged with each other, the first of the partial gears engageable by the transmission gear.

4. The printer of claim 3, wherein the second of the partial gears includes biasing means for urging the partial gears to a starting position after the position lever is displaced to the selected position.

5. The printer of claim 2, further including biasing means for stably biasing the paper holding means in the contact and separation positions.

6. The printer of claim 2, wherein the free end of the position lever is operatively engageable with, but not fixed to, the paper holding member.

7. The printer of claim 6, wherein the paper holding member is stably biased in the contact and in the separation positions by at least one biasing member.

8. The printer of claim 2, wherein the trigger means is selectively displaced from the non-engaged position to the engaged position by operation of an electro-magnetic member.

9. The printer of claim 8, further including biasing means for biasing the trigger means to the non-engaged position out of engagement with the platen power source, the electro-magnetic member overcoming the biasing force of the biasing means to engage the transmission means.

10. The printer of claim 2, wherein the free end of the position lever includes a first and a second contact surface spaced apart from each other, the first contact surface for displacing the paper holding member to the contact position when the position lever is in the contact position and the second contact surface for displacing the paper holding member to the separation position when the position lever is in the separation position to transmit motive force from the position lever to the paper holding member.

11. The printer of claim 2, wherein the paper holding member is stably biased by at least one spring to remain in both the contact and separation positions.

12. The printer of claim 11, wherein the position lever is not engaged with the paper holding member when the paper holding member is in the contact position.

13. The printer of claim 2, wherein the free end of the position lever includes at least two spaced surfaces for urging the paper holding member towards the contact and separation positions.

14. A printer including an apparatus for selectively moving a paper holding member between a contact position holding paper against a platen of the printer and a separation position away from the platen, comprising:

paper holding means including the paper holding member for holding paper to the platen;

a platen power source for rotating the platen coupled to the platen;

transmission means for selectively transmitting power from the platen power source to the paper holding means to move the paper holding member from the contact to the separation position or from the separation to the contact position including a gear plate pivotally mounted on the frame and a transmission gear rotated by the platen power source mounted on the gear plate and two epicyclic gears mounted on the gear plate engaged with the transmission gear, the gear plate selectively displaceable from the first non-engaged position to an engaged position in response to rotation of the transmission gear in a first direction and one of the epicyclic gears moves the paper holding member to the contact position engaged with the platen and when the transmission gear is rotated in the opposite direction the second of the epicyclic gears moves the lever to the separation position out of contact with the platen.

15. The printer of claim 14, wherein the epicyclic gears are selectively engageable by energizing an electro-magnetic means to selectively permit the gear plate to rotate into position so that one of the two epicyclic gears displaces the paper holding member.

16. The printer of claim 15, wherein the transmission means includes a trigger lever pivotally mounted on the frame and having a camming surface with an indent and the gear plate includes a projecting member which is engaged in the indent of the trigger lever when the epicyclic gears are in the non-engaged position, and when the electro-magnetic means is energized the trigger is displaced to free the projection from the indent to allow the gear plate to rotate into one of the two engagement positions.

17. The printer of claim 16 and including a cam arm operatively coupled to the paper holding member so that pivoting the cam arm moves the paper holding member between the contact and separation positions and an epicyclic lever pivotally mounted on the frame and having a gearing surface selectively engageable with either of the epicyclic gears when the gear plate is in the engagement position, wherein the epicyclic lever includes a cam projection in camming engagement with the cam arm and when either of the epicyclic gears engage the epicyclic lever, they pivot the epicyclic lever so that the cam projection will pivot the cam arm to displace the paper holding member between the contact and separation positions.

18. An apparatus for selectively moving a print paper holding member between a contact position holding a print paper against a platen of a printer and a separation position away from a platen, comprising:

paper holding means for supporting the paper holding member;

a platen power source for selectively rotating a platen;

power transmission means including a transmission gear for selectively transmitting power from the platen power source to the paper holding means to move the paper holding means between the contact and separation positions;

trigger means displaceable between a first idle position in which the platen power source is not engaged with the paper holding means and a second engaged position in which the platen power source is engaged with the paper holding means for displacing the paper holding means from the separation position to the contact position and from the contact position to the separation position;

the power transmission means including a positioning lever pivotally mounted in the apparatus, the positioning lever having a free end engaged with the paper holding means so that when the lever pivots, it displaces the paper holding means between the separation and contact position, the positioning lever also having a gear surface at the opposite end of the positioning lever so that when the lever is in the contact position and the trigger means is displaced to the engaged position the trigger means will selectively engage the lever gear surface and displace the lever to the separation position and when the lever is in the separation position the trigger means will selectively engage the lever gear surface to rotate the lever to the contact position; and the trigger means including a gear frame with first and second partial gears mounted on the gear frame for operative engagement with the gear surface of the lever and operatively engaged with each other, the first of the partial gears engageable by the transmission gear.

19. An apparatus for selectively moving a print paper holding member between a contact position holding a print paper against a platen of a printer and a separation position away from a platen, comprising:

paper holding means for supporting the paper holding member; a platen power source for selectively rotating a platen; and power transmission means for selectively transmitting power from the platen power source to the holding means to move the holding means between the contact and separation positions, the power transmission means including a gear plate pivotally mounted in the apparatus and a transmission gear rotated by the platen power source mounted on the gear plate, two epicyclic gears mounted on the gear plate and engaged with the transmission gear, the gear plate selectively displaceable from the first non-engaged position to an engaged position in response to rotation of the transmission gear in a first direction and one of the epicyclic gears moves the paper holding member to the contact position engaged with the platen and when the transmission gear is rotated in the opposite direction the second of the epicyclic gears pivots the paper holding member to the separation position out of contact with the platen, the transmission means further including a trigger lever having a camming surface with an indent and the gear plate includes a projecting member which is engaged in the indent of the trigger lever when the epicyclic lever is the non-engaged position, and an electro-magnetic means which, when energized causes the trigger to be displaced to free the projection from the indent to allow the gear plate lever to rotate into one of the two engagement positions.

* * * * *